United States Patent [19]

Goodridge et al.

[11] 4,421,613

[45] Dec. 20, 1983

[54] PREPARATION OF HYDROXY COMPOUNDS BY ELECTROCHEMICAL REDUCTION

[75] Inventors: Francis Goodridge, Newcastle-upon-Tyne; Anthony J. Montgomery, Brentwood; Alan R. Wright, Walsend, all of England

[73] Assignee: Bush Boake Allen, London, England

[21] Appl. No.: 400,470

[22] Filed: Jul. 21, 1982

Related U.S. Application Data

[63] Continuation of Ser. No. 222,997, Jan. 6, 1981, abandoned.

[30] Foreign Application Priority Data

Jan. 7, 1980 [GB] United Kingdom ..... 8000423

[51] Int. Cl.[3] ..... C25B 3/04

[52] U.S. Cl. ..... 204/74; 204/72; 204/59 R

[58] Field of Search ..... 204/74, 59 R, 72

[56] References Cited

U.S. PATENT DOCUMENTS 4,107,219 8/1978 Murata et al. ..... 508/875

FOREIGN PATENT DOCUMENTS 141346 4/1903 Fed. Rep. of Germany ..... 204/74

*Primary Examiner*—F. Edmundson

*Attorney, Agent, or Firm*—Kane, Dalsimer, Kane, Sullivan & Kurucz

[57] ABSTRACT

Organic hydroxy compounds such as geraniol are prepared by electrochemical reduction of a corresponding substituted hydroxylamine, typically in a cell wherein the catholyte comprises a solvent and a protonating agent as well as the substituted hydoxy cycloamine and is separated from the anolyte by a membrane, the anolyte preferably containing an aqueous strong mineral acid.

14 Claims, 1 Drawing Figure

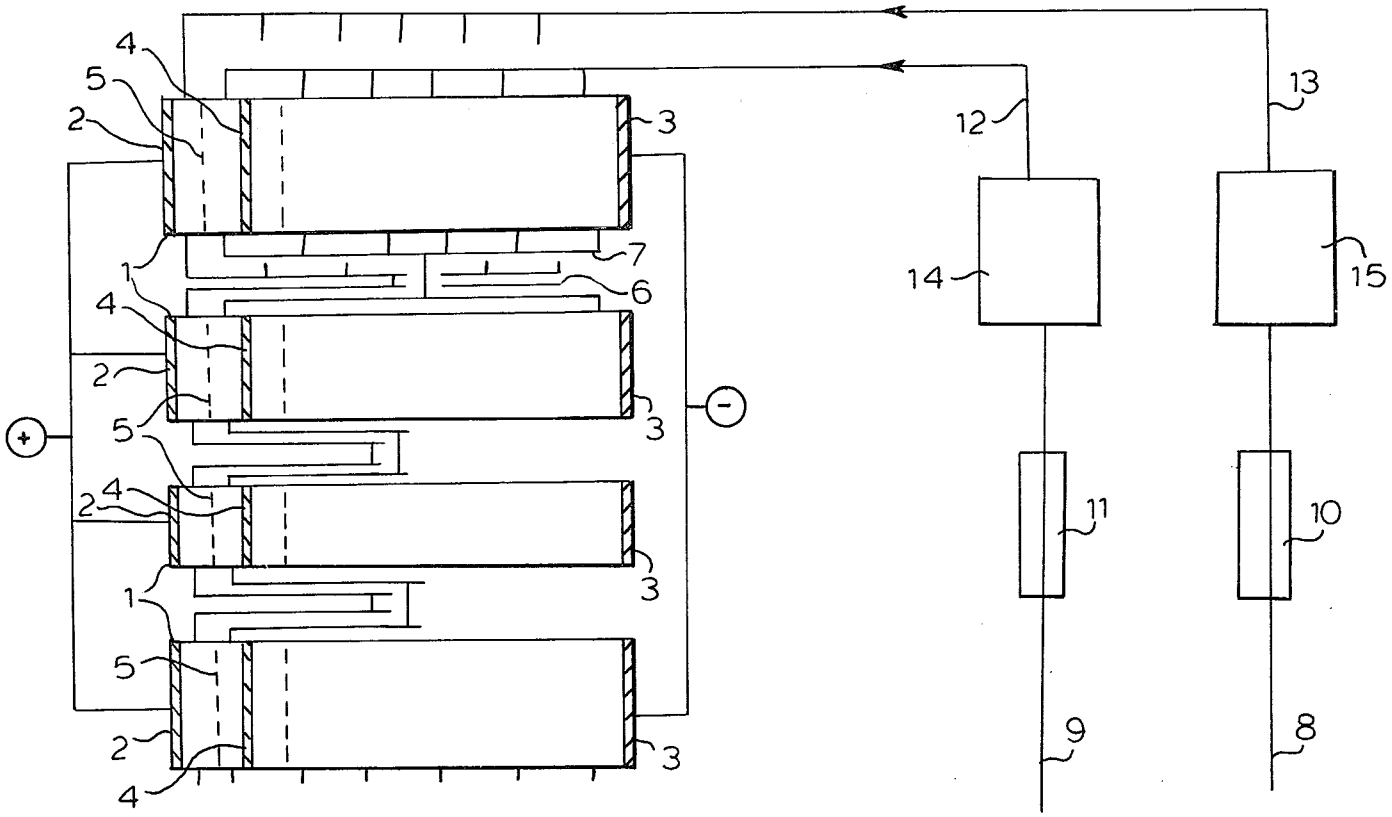
15
13
10
8
11
9
12
14
3
7
6
3
3
3
4
5
2
1
4
2
5
2
4
1
5
2
4
-
+

PREPARATION OF HYDROXY COMPOUNDS BY ELECTROCHEMICAL REDUCTION

This is a continuation of application Ser. No. 222,997 filed Jan. 6, 1981 and now abandoned.

The present invention relates to a method for the preparation of organic hydroxy compounds such as alcohols or phenols by the electrochemical reduction of substituted hydroxylamines.

The invention is of particular value in the preparation of terpene alcohols such as geraniol and nerol which are important products in the perfumery industry. For example, a process is known, from British Pat. No. 1,535,608 or U.S. Pat. No. 4,107,219, whereby isoprene may be reacted with a secondary amine in the presence of a catalyst such as butyl lithium to form a terpene amine. The latter can be converted to an alkoxydialkylamine, which on catalytic hydrogenation yields geraniol and/or nerol. Unfortunately the final stage in the preparation is a difficult high pressure hydrogenation which gives relatively low space yields of the alcohol, thereby limiting the commercial value of what would otherwise be an economically attractive route for the synthesis of terpene alcohols.

We have now discovered that substituted hydroxylamines such as the alkoxydialkylamine precursor of geraniol may be converted to the corresponding alcohols by electrochemical reduction in very high yields and with high electrical efficiency.

Our invention provides a method for the preparation of hydroxy compounds ROH, wherein R represents a hydrocarbon or substituted hydrocarbon group, which comprises contacting a solution of a substituted hydroxylamine of the formula $RONR'_2$, wherein each R' is hydrogen or a hydrocarbon or substituted hydrocarbon group or $NR'_2$ represents a nitrogen containing heterocyclic ring, in an electrically conductive, liquid medium, with at least the cathode of an electrolytic cell, and passing an electric current through said liquid medium between said cathode and an anode.

The group R is usually a hydrocarbon group such as an alkyl, alkenyl, aryl, aralkyl, alkaryl or alicyclic group. Preferably R is an aliphatic group having from three to thirty carbon atoms, especially a terpene, diterpene, sesquiterpene, or triterpene hydrocarbon group such as geranyl, neryl or linalyl. The hydrocarbon group may be substituted with any non-reducible substituent such as hydroxy, lower alkoxy (e.g. $C_{1-3}$) or amine, e.g. hydroxy geranyl hydroxy neryl or hydroxy linabyl. Mixed feeds may be used.

Each R' may be hydrogen, but preferably is a lower (e.g. 1 to 4 carbon) alkyl group. Alternatively it may be an aryl, alkenyl or cycloalkyl group, or a higher alkyl group having up to 20 carbon atoms. The R' groups may be the same or different. In one embodiment the R' groups are joined to form, with the N atom, a nitrogen containing ring such as piperidine.

The electrolyte may be homogeneous between the cathode and anode, but preferably the anode and cathode are separated by a membrane or diaphragm, and the composition of catholyte and anolyte may then differ. The catholyte preferably comprises a solvent for the substituted hydroxylamine, a source of electrical conductivity, and a source of protons, as well as the substituted hydroxylamine and any product alcohol or by-products (e.g. amine) which may have been formed. Typically the system also contains some water.

In certain circumstances the same substance may fulfil more than one of above functions, e.g. acetic acid may function as solvent, protonating agent and provide electrical conductivity.

The solvent may typically be a lower (e.g. $C_{1-4}$) alcohol such as methanol, ethanol, n-propanol, n-butanol tertiary butanol or isopropanol, preferably methanol. However any other organic solvent capable of dissolving the substituted hydroxylamine may be present.

The protonating agent where present is typically a weak acid. We particularly prefer that an organic acid, usually a lower (e.g. $C_{1-4}$) carboxylic acid such as acetic acid, should be present. Strong mineral acids are preferably absent from the catholyte since they tend to destroy the product. The preferred acid is acetic acid. Generally it is preferred that the catholyte has an acid pH sufficient to promote the electrochemical reaction (possibly by protonating the substituted hydroxylamine) but not to destroy the alcohol product. We prefer for most purposes to operate in the pH range 3 to 6.5 although operation outside this range is possible, and may be preferable in specific instances.

We prefer the catholyte to contain a conductivity promoter which is a readily ionisable compound such as an alkali metal salt of a strong acid. Lithium salts such as lithium chloride are useful because of their high solubility, but sodium salts such as sodium sulphate or, especially, sodium chloride are preferred on economic grounds. Potassium salts may also be used, as may ammonium salts, preferably tetra-alkyl ammonium salts such as tetraethyl ammonium chloride.

The concentration of the substituted hydroxylamine in the catholyte is not critical and, in batch operations, will fall to substantially zero as the reaction proceeds to completion. Generally speaking, on economic grounds, it is desirable to use the highest starting concentration possible, but preferably not greater than is soluble in, and compatible with, the catholyte without causing precipitation or phase separation of one or more of its components although we do not exclude operation in the presence such separation phases. The optimum concentration will depend upon the particular starting material and catholyte, but in a typical instance would be in the range 10 to 20% by weight. In some instances however higher starting concentrations are possible and, may be preferred particularly where the hydroxylamine is specially purified e.g. by distillation. In the latter case concentrations up to 50% or higher are practicable and offer advantages. In some instances emulsions may be used.

While it is possible to operate with a completely anhydrous system we prefer that the catholyte contains at least some water to assist conductivity, e.g. 1–30%, typically 2 to 25%, e.g. 5 to 20% by weight.

Usually the catholyte contains from 10 to 90%, preferably 20 to 85%, more usually 35 to 80%, e.g. 50 to 70%, by weight of solvent; 2 to 40%, preferably 5 to 30% by weight of protonating agent; and 1% up to saturation, preferably 2 to 20%, e.g. 5 to 10% by weight of conductivity promoter. The above proportions may be varied considerably, particularly when one or more of the components is capable, to some extent, of performing more than one of the above functions. For example where acetic acid is used as the protonating agent a large excess, e.g. up to 90% preferably 50 to 70% may be used, the excess acting as at least part of the solvent.

While it is possible for the anolyte and catholyte to be the same, we prefer to separate the electrodes by a membrane and to maintain a separate anolyte. Typically the anolyte comprises an aqueous strong mineral acid, preferably sulphuric acid, although other acids such as hydrochloric acid or phosphoric acid, and mixtures of acids are all operable but generally less preferred.

The cathode maybe of any electrically conductive material, stable in a reducing environment, which desirably favours reduction of the hydroxylamine in preference to generation of hydrogen, e.g. a metal with a sufficiently high hydrogen over potential to suppress the formation of hydrogen or one which catalyses the reduction of the hydroxylamine. On grounds of cost and effectiveness we prefer lead. Other materials which may be used include zinc, cadmium, mercury and carbon.

The anode may be any electrically conductive material suitable for oxygen evolution. Any oxide coated metal suitable for water electrolysis in acid conditions may be used, such as lead dioxide coated on lead, titanium, or similar supporting materials. Carbon may also be used.

For commercial use it is strongly preferred to combine a number of unit cells connected in series into a pack, each cell being physically separated from, and electrically connected to, its neighbours by a bipolar electrode.

The preferred bipolar electrode comprises a lead sheet as the cathodic face and titanium coated with ruthenium oxide as the anodic face. Alternatively, we can use a lead sheet coated with lead oxide on its anodic face. The lead oxide coating may be preformed or allowed to form in situ by the operation of the cell. Other conventional dimensionally stable bipolar electrodes may be used, as may carbon, although the last mentioned is not preferred due to problems of erosion and contamination of the product with carbon particles.

Preferably the cathode and anode in each unit cell are separated by a membrane, which is preferably cation selective, e.g. a sulphonated polyester membrane. It is possible, less preferably, to use a porous diaphragm to separate the electrodes.

It is highly desirable to maintain a circulation of liquid through the cell in order to prevent accumulations of hydrogen on the cathode face. Temperature is not critical provided it is not sufficiently high to vapourise components of the catholyte to an unacceptable extent or so low as to cause solidification, precipitation or other phase separation.

The preferred temperature is from 20° to 50° C. e.g. 30° to 40° C. The process may generate heat, and provision may be made, if desired, for cooling the electrolyte, for example, by circulating it through an external heat exchanger.

It is often desirable to carry out the process in an inert atmosphere such as nitrogen to reduce fire hazards.

The process is operable over a very wide current density range.

The recovery of the product may be effected by conventional separatory techniques, usually some combination of one or more of the steps of precipitation, filtration, evaporation, dilution to effect phase separation and fractional distillation, depending upon the particular nature of the product and composition of the anolyte.

The process may be operated batchwise, e.g. by maintaining reservoirs of catholyte and anolyte, the former containing a dissolved batch of starting material, and circulating the two solutions through the cathode and anode compartments respectively of the cell, until the conversion is complete or has reached a desired level. The product may then be recovered from the catholyte solution. Alternatively, the above system may be adapted to continuous operation by recovering the product and any by-product amine continuously or intermittently from the circulating solution at a convenient stage in the cycle and replenishing the solution continuously or intermittently bleeding off the circulating solution to the recovery stage.

Typically a number of unit cells are combined in electrical series to form a cell pack and a number of cell packs are connected electrically in parallel. Conveniently both anolyte and catholyte flow is parallel through the unit cells of each pack and in series through the successive cell packs.

Various other arrangement of unit cells, cell packs and reagent flows are possible.

BRIEF DESCRIPTION OF THE DRAWING

A typical electrochemical reduction plant suitable for carrying out the invention will be described with reference to the accompanying drawing which is a diagramatic flow sheet.

The plant comprises a series of cell packs (1). Each cell pack (1) comprises a lead oxide coated lead terminal anode (2) and a lead terminal cathode (3) separated by a plurality of bipolar electrodes (4), each of which is a lead sheet coated on its anode face with lead dioxide, and which define a plurality of unit cells.

Each unit cell is divided into anolyte and catholyte compartments by a cation selective membrane (5). Each anolyte compartment and each catholyte compartment is connected to each corresponding compartment of the next successive cell pack in the series by anolyte and catholyte transfer manifolds (6) and (7) respectively. The anolyte compartments and catholyte compartments of the last cell pack in the series discharge respectively into an anolyte recycle manifold (8) and a catholyte recycle manifold (9), which are provided with heat exchangers (10) and (11) respectively.

The catholyte and anolyte compartments of the first cell pack in the series are supplied respectively by a catholyte feed manifold (12) and an anolyte feed manifold (13). The catholyte feed manifold (12) and the catholyte recycle manifold (9) are connected to a catholyte reservoir (14). The anolyte feed manifold (13) and the anolyte recycle manifold (8) are connected to an anolyte reservoir (15).

The terminal anodes (2) and the terminal cathodes (3) are connected in parallel to the positive and negative terminals respectively of a D.C. power source.

The invention is illustrated by the following example.

All percentages are by weight unless stated to the contrary.

EXAMPLE 1

A glass cell comprising an anode chamber, a cathode chamber and a cationic membrane separating the two was used. The cathode was in the form of a lead sheet approx. 5 $cm^2$ in area, the anode a lead dioxide coated lead rod of similar cross-sectional area. Nitrogen gas was continuously bubbled through the catholyte to provide agitation. Electrolysis was carried out under either constant current or constant electrode potential conditions.

Using this apparatus in one experiment, the anolyte solution consisted of an aqueous 10% solution of sulphuric acid and the catholyte was made up of 59% methanol, 29% glacial acetic acid and 12% water in which had been dissolved 6% of lithium chloride and 10% of N-(3,7, dimethylocta-2,6 dien-1-yloxy) diethylamine. The electrolysis was carried out at constant electrode potential and the average current density was 20 mA/cm$^2$. The reaction was continued until substantially all the starting material had been converted into a mixture of geraniol and nerol. The initial current efficiency was in excess of 90%.

EXAMPLE 2

Aqueous sulphuric acid (10% w/w) was used as the anolyte. The anode was lead dioxide layer on lead and the cathode was lead with an area of 0.05 sq.m. The cathode and anode compartments were separated by an "Ionac" cationic membrane. The catholyte composition was as follows:

300 gms Neryl/Geranyl Hydroxylamines (90% pure by GLC)
1100 gms Glacial Acetic Acid
1100 gms Methanol
300 gms Water
30 gms Sodium Chloride A nitrogen bleed of 40 mls/min was pumped into the cathode resevoir.

Both catholyte and anolyte were pumped through the cell at a rate of 12 liters/min. A current of 40 amps was maintained by adjusting the voltage between a range of 9–15 volts. The temperature of the catholyte was maintained at 18° C. The current was passed for 2.5 hours.

| RESULTS | |
|---|---|
| Current Density | 800 ams/sq m |
| GLC Analysis Nerol | 36% |
| GLC Analysis Geraniol | 64% |
| Current efficiency | 67% |
| K. watt hrs. per Kg. | 6.0 |

EXAMPLE 3

Aqueous sulphuric acid (10% w/w) was prepared and used as the anolyte. The anode consisted of lead dioxide on lead and the cathode was lead. The cathode area was 0.05 sq.m. Cathode and anode compartments were separated by a sheet of Ionac cationic membrane. Catholyte composition was as follows:

300 gms Neryl/Geranyl Hydroxylamines (90% pure by GLC)
1900 gms Methanol
300 gms Glacial Acetic Acid
300 gms Water
30 gms Sodium Chloride A nitrogen bleed of 40 mls/min was pumped into the cathode resevoir.

Both catholyte and anolyte were pumped through the cell at 12 liter/min. A current of 40 amps was maintained by adjusting the cell voltage between 7.5 and 12 volts. The catholyte temperature was held at 21° C. Current was passed for 3 hours.

| RESULTS | |
|---|---|
| Current Density | 800 amps/sq m |
| GLC Analysis Nerol | 35.5% |
| GLC Analysis Geraniol | 63.9% |
| Current efficiency | 55% |

-continued

| RESULTS | |
|---|---|
| K. watt hrs. per Kg. | 5.2 |

We claim:

1. A method for the preparation of an organic hydroxy compound of the formula ROH, wherein R represents a terpenoid group, by electrochemical reduction of a substituted hydroxylamine of the formula RONR'$_2$ wherein each R' is hydrogen or a hydrocarbon or substituted hydrocarbon group or NR'$_2$ represents a nitrogen-containing organic heterocyclic ring in an electrolytic cell comprising a cathode, a catholyte at a pH of from 3 to 6.5 in contact with the cathode, an anode, an anolyte in contact with the anode and a membrane separating the catholyte from the anolyte and in which the catholyte is electrically conducting and consists essentially of an organic carboxylic acid and a solution of the substituted hydroxylamine and the organic hydroxy compound is recovered from the catholyte.

2. The method according to claim 1, in which the catholyte consists essentially of the organic carboxylic acid and the solution of the substituted hydroxylamine and a conductivity promoter selected from ammonium and alkali metal salts of strong acids.

3. The method according to claim 1, in which the catholyte consists essentially of the organic carboxylic acid and the solution of the substituted hydroxylamine and a conductivity promoter selected from the chlorides and sulphates of lithium, sodium, potassium, unsubstituted ammonium and tetralkyl ammonium wherein each alkyl group has less than 4 carbon atoms.

4. The method according to claim 1, in which the catholyte contains acetic acid.

5. The method according to claim 1, in which the solution of the said hydroxylamine in the catholyte is in an alcohol having 1 to 4 carbon atoms.

6. The method according to claim 1, in which the solution of the said hydroxylamine is a solution in methanol.

7. The method according to claim 1, in which the catholyte consists essentially of from 1 to 50% by weight of the substituted hydroxylamine, 0 to 30% by weight water, 1 to 90% by weight alcohol having 1 to 4 carbon atoms, 1 to 90% by weight acetic acid and 1% to saturation of a salt selected from the group consisting of chlorides and sulphates of lithium, sodium, potassium, unsubstituted ammonium and tetralkyl ammonium wherein each alkyl group has from 1 to 4 carbon atoms.

8. The method according to claim 1, in which the anolyte consists essentially of an aqueous strong mineral acid.

9. The method according to claim 1, in which the anolyte consists essentially of an aqueous acid selected from sulphuric, hydrochloric and phosphoric acids.

10. The method according to claim 1, in which the group R is selected from terpene, diterpene, sesquiterpene and triterpene groups.

11. The method according to claim 1, in which the group R is selected from geranyl, neryl, linalyl, hydroxygeranyl, hydroxyneryl and hydroxylinalyl groups.

12. The method according to claim 7, in which the group R is selected from geranyl, neryl, linalyl, hydroxygeranyl hydroxyneryl and hydroxylinalyl groups.

13. The method according to claim 1, in which each group R' is an alkyl group having from 1 to 4 carbon atoms.

14. The method according to claim 1, in which the organic carboxylic acid contains from 1 to 4 carbon atoms.

* * * * *